US008701396B2

(12) United States Patent
Narotham et al.

(10) Patent No.: US 8,701,396 B2
(45) Date of Patent: Apr. 22, 2014

(54) HYDRAULIC SYSTEM

(75) Inventors: Harishchandra M. Narotham, Crewe (GB); Martin R. Smith, Stafford (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 802 days.

(21) Appl. No.: 12/838,166

(22) Filed: Jul. 16, 2010

(65) Prior Publication Data

US 2011/0011071 A1 Jan. 20, 2011

(30) Foreign Application Priority Data

Jul. 20, 2009 (GB) ..... 0912540.2

(51) Int. Cl.
*F15B 11/02* (2006.01)
*F15B 13/00* (2006.01)

(52) U.S. Cl.
USPC ..... 60/327; 60/452; 60/468; 60/494

(58) Field of Classification Search
USPC ..... 60/468, 445–452, 459, 494, 327; 91/47, 91/446, 433, 443
See application file for complete search history.

(56) References Cited

U.S. PATENT DOCUMENTS 4,808,088 A * 2/1989 Missfeldt ..... 417/395
4,811,649 A * 3/1989 Heusser ..... 91/47
4,977,928 A 12/1990 Smith et al.
5,201,803 A * 4/1993 Goto et al. ..... 60/422
5,848,531 A * 12/1998 Nakamura et al. ..... 60/426
6,367,365 B1 4/2002 Weickert et al.
6,901,754 B2 * 6/2005 Jervis ..... 60/468

(Continued)

FOREIGN PATENT DOCUMENTS

EP 0427865 A1 5/1991
EP 0468944 A1 1/1992

(Continued)

OTHER PUBLICATIONS

Search Report for GB 0912540.2, dated Nov. 25, 2009.

(Continued)

*Primary Examiner* — Edward Look
*Assistant Examiner* — Logan Kraft
(74) *Attorney, Agent, or Firm* — Marshall, Gerstein & Borun LLP

(57) ABSTRACT

A hydraulic system for an operator controlled machine, the system including at least one actuator for moving a machine component, a source of pressurized fluid for delivering pressurized fluid at a system pressure to a control valve which is operable under operator control, to control the flow of fluid from the source to the actuator at a load pressure, along a load pressure path, a flow control apparatus for controlling the flow of fluid from the source to the control valve, the flow control apparatus including an actuating part which is biased by a resilient device to a condition in which the flow control apparatus provides for a maximum flow of fluid to the control valve, actuating part movement by the resilient device being resisted by system pressure fluid and being supported by fluid at a control pressure, the control pressure being derived from the load pressure, and wherein the system includes a pressure control device to which the load pressure is communicated, the pressure control device being operated under operator control either to deliver the control pressure to the flow control device at load pressure or a modified pressure which is less than the load pressure.

18 Claims, 5 Drawing Sheets

(56) References Cited

U.S. PATENT DOCUMENTS

| | | | | |
|---|---|---|---|---|
| 7,802,971 | B2 * | 9/2010 | Schneider et al. | 417/220 |
| 2002/0014075 | A1 | 2/2002 | Sawada et al. | |
| 2006/0090460 | A1 | 5/2006 | Ma et al. | |
| 2006/0243128 | A1 | 11/2006 | Ma et al. | |
| 2008/0295681 | A1 | 12/2008 | Ma et al. | |

FOREIGN PATENT DOCUMENTS

| | | | |
|---|---|---|---|
| EP | 0 513 360 | A1 | 11/1992 |
| EP | 0608415 | | 8/1994 |
| EP | 1 710 443 | A2 | 10/2006 |
| EP | 2189666 | A1 | 5/2010 |
| GB | 2279776 | A | 1/1995 |
| WO | WO-98/46883 | A1 | 10/1998 |

OTHER PUBLICATIONS

Extended European Search Report for Application No. 10169644.1, dated Oct. 7, 2013.

* cited by examiner

HYDRAULIC SYSTEM

BACKGROUND TO THE INVENTION

This invention relates to a hydraulic system and more particularly to a hydraulic system for effecting the operation of at least one actuator of a working machine.

DESCRIPTION OF THE PRIOR ART

Hydraulic systems are known for use in working machines which include an actuator for moving a machine component such as a working arm which carries a working implement such as for example only, an excavating bucket, relative to a machine body.

Such systems typically include a source of pressurized hydraulic fluid, typically a pump driven from an engine of the machine, and a control valve which may include one or more spools or the like, to control the flow of fluid provided by the pump, to a or a respective one of one or more downstream actuators, the pressure downstream of the control valve being a load pressure, or where there are a plurality of spools or the like which are operated simultaneously, an maximum load pressure.

In one example, the pump is a fixed capacity pump whose output is generally constant for a given machine engine speed. It is known to provide a flow control apparatus in the nature of a pressure relief valve, so that excess fluid which is delivered by the pump, can be relieved to a low pressure region e.g. fluid reservoir, when this fluid is not required for the actuator or actuators, depending on the load pressure. Such a flow control apparatus typically includes a resilient device to bias an actuating part towards a closed condition when all, or at least a maximum flow of system pressure fluid is provided to the actuator or actuators. The system pressure is communicated to the pressure relief valve to act on the actuating part to oppose the resilient device force to tend to move the actuating part to an open condition so that at least a proportion of the system pressure fluid passes through the flow control apparatus to the low pressure region, thus at least minimizing the fluid flow to downstream of the control valve, and fluid at load pressure communicated to the pressure relief valve to act on the actuating part to support the resilient device. Thus as the control valve is opened the resistance of the load to actuator operation will develop a load pressure which is communicated to the pressure relief valve, at least partially to close the pressure relief valve. Thus the system pressure, i.e. the pump pressure, will rise, leading to an increased flow through the control valve and less fluid passing to the low pressure region.

Thus there will be a pressure drop across the control valve equivalent to the biasing force of the resilient device. If the load pressure decreases for example as the control valve is closed, the pressure relief valve opens and the system pressure upstream of the control valve will decrease similarly, i.e. by the same amount, thus keeping the pressure difference between the system pressure and the load pressure, i.e. the pressure difference across the control valve, constant.

In another example, the pump is a variable capacity pump whose output is varied depending on the amount of fluid required to be supplied to the actuator or actuators. In one example, a flow control apparatus includes the pump, or at least an actuating part of the pump, such as a swashplate. The flow control apparatus may include a resilient device which is biased in a direction to control the pump to deliver a maximum flow of fluid to the control valve. System pressure is communicated to the flow control device and acts to oppose the force of the resilient device on the actuating part, and load pressure is also communicated to the actuating part to support the resilient device.

It will be appreciated that in order to provide for the fastest actuator operation, for example when transporting materials in a bucket on an excavating arm from a loading to an unloading location, the control valve is required to open to permit the maximum flow of fluid through the control valve, for a given movement of a manual control.

As there is generally a linear relationship between movement of the manual control and flow through the control valve, this means that good (fine) flow control can only be achieved in response to small movements of the manual control, thus requiring more precision on the part of the operator. However where fine control of the actuator is required, e.g. during excavating operations, slower actuator movements are desirable for greater manual control movements. With conventional systems the control valve design is necessarily a compromise between control valve designs which permit the greatest fluid flow when fully open, these being most suitable where actuator speed is a priority, and those which permit a lesser fluid flow, which designs are most suitable for more accurate actuator control.

SUMMARY OF THE INVENTION

According to a first aspect of the invention we provide a hydraulic system for an operator controlled machine. The system may include at least one actuator, a source of pressurized fluid for delivering pressurized fluid at a system pressure to a control valve which is operable under operator control, to control the flow of fluid from the source to the actuator along a load pressure path, and a flow control apparatus for controlling the system pressure and hence the flow of fluid from the source through the control valve, depending on the load pressure in the load pressure path. The flow control apparatus may include an actuating part which is biased by a resilient device towards a condition in which the flow control apparatus provides for a maximum flow of fluid through the control valve, actuating part movement by the resilient device being supported by fluid at a control pressure. The control pressure may be derived from the load pressure. The system may include a pressure control device to which the load pressure is communicated, the pressure control device being operated under operator control either to deliver the control pressure to the flow control device at load pressure or a modified pressure which is less than the load pressure.

The present invention utilizes the principle of varying the fluid flow to the control valve, by relieving excess fluid provided by a fixed capacity pump, or reducing the output of a variable capacity pump, depending on the load pressure, but enables a greater flow of fluid through the control valve e.g. for faster actuator operation, by delivering the control pressure at the load pressure to the flow control apparatus, or a lesser flow of fluid to the control valve e.g. for slower more controlled actuator operation, by delivering the control pressure to the flow control apparatus at the modified pressure less than the load pressure.

Thus there is no need to compromise the design of the control valve which may thus permit the greatest fluid flow to the actuator (or actuators) for a particular control valve setting, as the system pressure will lead to the maximum fluid flow through the control valve, and in the case where slower fine actuator control is required, by operating the pressure control device so that the control pressure which is delivered to the flow control apparatus is the modified load pressure, so for the same load and control valve setting, less fluid will flow through the control valve allowing greater actuator control by the control valve.

The present invention is applicable both to hydraulic systems in which the source of pressurized fluid is a fixed capacity pump and/or a variable capacity pump.

In the case of the fixed capacity pump the flow control apparatus may be a pressure relief valve, the actuating part being a valve member in a flow path though a valve body, the valve member being moveable in a passage in the body and being acted upon in one direction by the resilient device and the control pressure fluid, and in the opposite direction by the system pressure fluid.

Thus the body may include a system pressure fluid inlet port for system pressure fluid which is connected to the source, and a port for control pressure fluid which is connected to the load pressure path.

In this case, preferably there is a relief drain to a low pressure region to relieve any trapped control pressure fluid between the pressure control device and the flow control apparatus, which could affect the ability of the pressure relief valve fully to open, e.g. when the control valve is closed.

In the case of a variable capacity pump, the flow control apparatus may include an actuating part of the pump which is moveable to increase or decrease the capacity of the pump. For example the actuating part may be a swashplate. The resilient device of the flow control apparatus may act with the control pressure to bias the actuating part in a first direction to move the actuating part so that the pump delivers a maximum output pressure and hence flow of fluid through the control valve. The system pressure fluid may be communicated to act on a piston connected to the actuating part, to oppose the biasing of the resilient device and the control pressure, to tend to move the actuating part to decrease the output of the pump. The control pressure fluid may be communicated to a further piston connected to the actuating part to support the biasing of the resilient device. The resilient device may be provided in a cylinder which houses the piston on which the control pressure acts, to act on the piston with the control pressure.

The pressure control device may in one example include a simple changeover device e.g. an electrically controlled or pilot controlled valve which may manually be operated, or the changeover device may be responsive to an input from a controller which depends on any desired operating parameters, in each case, to change the state of the changeover valve to deliver the control pressure fluid at either the load pressure through a first control pressure delivery path, or the modified pressure through a second control pressure delivery path which includes a pressure reducing orifice.

In another example, the pressure control device may be a variable orifice, which again may be an electrically controlled or pilot controlled valve which may manually be operated, or the variable orifice may be responsive to an input which senses operation of manual control of the control valve in each case to vary the control pressure from the load pressure to a modified lower load pressure depending on the extent of opening of the variable orifice.

According to a second aspect of the invention we provide a working machine which includes a hydraulic system according to the first aspect of the invention.

According to a third aspect of the invention we provide a method of operating a hydraulic system of an operator controlled machine in which the hydraulic system includes at least one actuator for moving a machine component, a source of pressurized fluid for delivering pressurized fluid at a system pressure to a control valve which is operable under operator control, to control the flow of fluid from the source to the actuator, along a load pressure path, and a flow control apparatus for controlling system pressure and hence the flow of fluid from the source through the control valve depending upon the load pressure in the load pressure path. The flow control apparatus may include an actuating part which is biased by a resilient device towards a condition in which the flow control apparatus provides for a maximum flow of fluid to the control valve, actuating part movement by the resilient device being supported by fluid at a control pressure. The control pressure may be derived from the load pressure, and wherein the system includes a pressure control device to which the load pressure is communicated. The method may include operating the pressure control device either to deliver the control pressure to the flow control device at load pressure or a modified pressure which is less than the load pressure.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
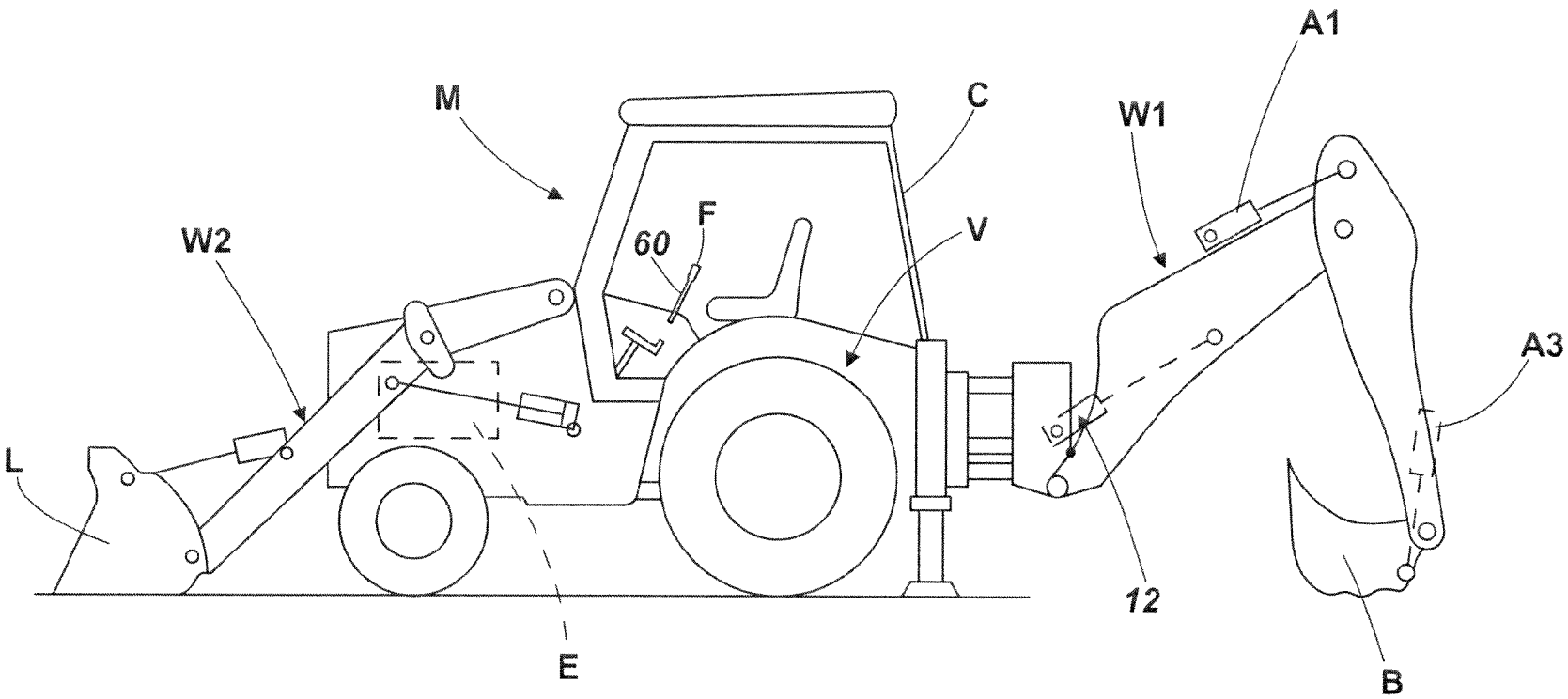
FIG. 1 is an illustrative side view of a working machine which has a hydraulic system in accordance with the invention.

Referring to FIG. 1 there is shown a working machine M which has a body V which mounts a working arm W1, W2. The machine M of FIG. 1 has both a working arm W1 for excavating operations, at the rear in the example, and a working arm W2 for loading operations, at a front in the example.

Embodiments of the invention will now be described more particularly in relation a hydraulic system 10 for operating a lifting actuator 12 of the excavating arm W1, which when extended raises the excavating arm W1 relative to the body B. However it will be appreciated that a hydraulic system in accordance with the invention may be used to operate other actuators which operate the excavating arm W1 and/or an implement e.g. bucket B carried by the excavating arm W1, e.g. as shown at A2, and A3. Further alternatively a hydraulic system in accordance with the invention may be used to operate actuators of the loading arm W2 or loading implement L carried thereby.

Figure 2:
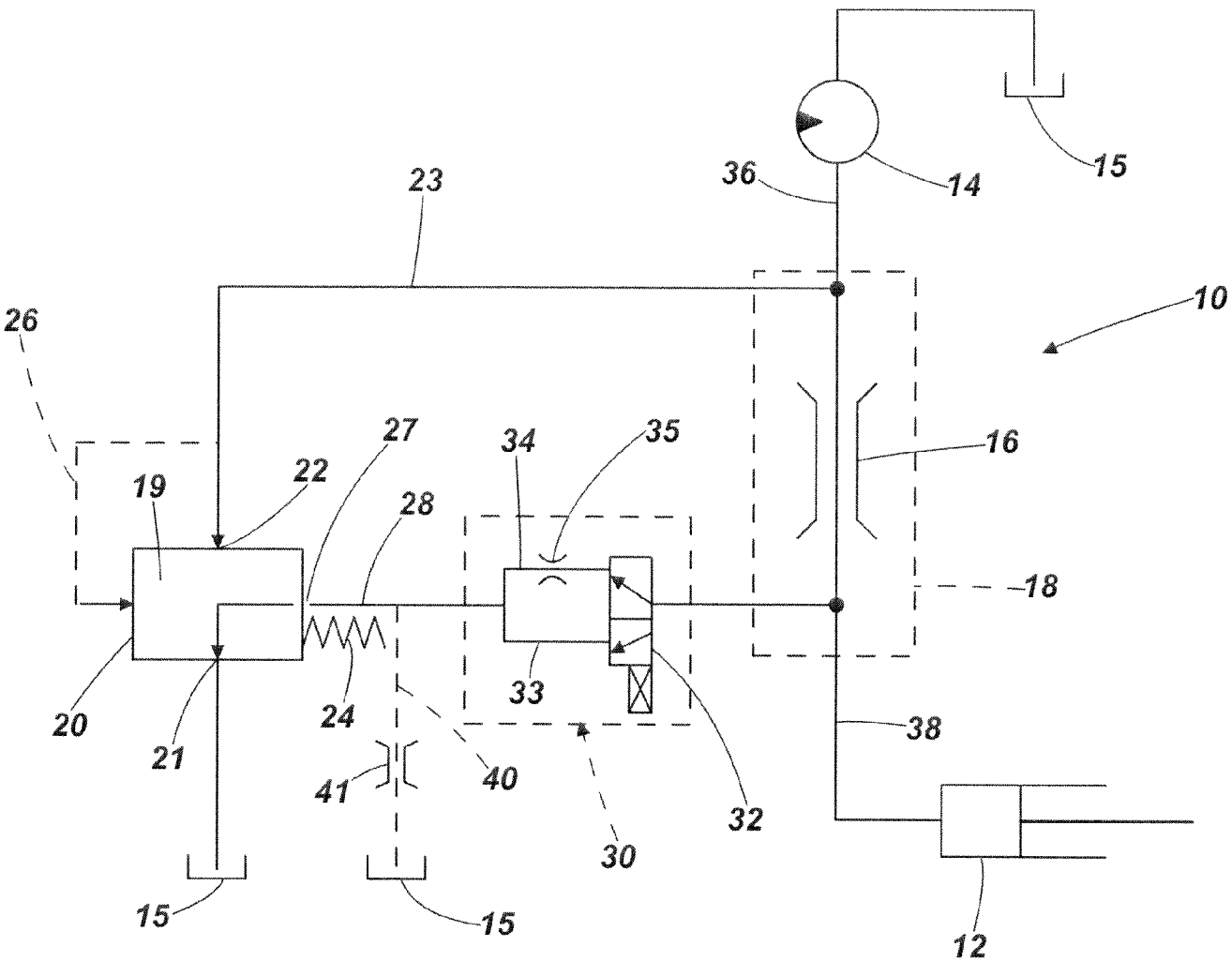
FIG. 2 is an illustrative diagram of a first hydraulic system in accordance with the present invention.

Referring to FIG. 2 a first hydraulic system 10 in accordance with the present invention is illustrated diagrammatically.

The system 10 includes the actuator 12 for moving the excavating arm W1 of the working machine M relative to the body V of the machine M, for example in conveying a load from a loading location, in the excavating bucket B, to an unloading location, in one mode of operation, or for moving the excavating arm W1 during a trench digging or other excavating operation in another mode of operation.

The actuator 12 is powered by pressurized hydraulic fluid which is provided from a source which in the example, is a pump 14 which draws the fluid from a reservoir 15 which is a low pressure area, and delivers the fluid to a control valve 16, which typically would be a spool in a valve block 18, which is moved by manual or electrical/hydraulic pilot control to vary the fluid flow past the spool, and hence to the actuator 12.

In the example, for illustrative purposes only, the actuator 12 is shown in FIG. 2 as a single acting actuator 12 but in a practical arrangement would be a double acting actuator, with the control valve 16 being operative to deliver pressurized fluid to the actuator 12 to extend or retract the actuator 12 depending upon the operation of the control valve 16.

In this example, the pump 14 is a fixed capacity pump 14 which is connected to a prime mover such as an engine E of the working machine M, and delivers a fixed flow of fluid depending upon the engine E speed and pump 14 capacity. Typically during an excavating operation, the engine E speed is set to a speed which is most efficient from the power delivery and fuel consumption points of view.

At least when the control valve 16 is not opened to its fullest extent, at least a proportion of the pressurized fluid which is delivered by the pump 14 is not required by the actuator 12, and as is well know in the art, a flow control apparatus 20 is provided, to vary the flow of the pressurized fluid through the control valve 16.

In this example, the flow control apparatus 20 is a pressure relief valve, which has a body 19 with an outlet port 21 connected to the low pressure region 15, and an inlet port 22 to which is connected fluid, in this example via a line 23, delivered by the pump 14 which is at a system pressure. Within the body 19 of the flow control device 20 there is a flow path from the inlet 22 to the outlet port, and an actuating part such as a valve member in a passage between the inlet 22 and outlet 21 ports, the actuating part being biased in a direction towards a position in which the flow path closes and fluid is prevented or restricted, from flowing from the inlet 22 to the outlet 21 port, by a resilient device 24 which in this example is a spring.

As is also known in the art, the force of the spring 24 is supported by a control pressure delivered to another port 27 of the relief valve body 19 of the flow control device 20, from a load path 28, the control pressure being derived from the load pressure, that is the pressure downstream of the control valve 16, which is derived by the actuator 12.

As the control valve 16 is opened, a load pressure will be established in the load pressure line 38 between the control valve 16 and the actuator 12 by the resistance of the actuator to the fluid provided. This load pressure may be transmitted as described below, to the flow control apparatus 20 to act with the spring 24 to tend to close the pressure relief valve 20. This will cause the system pressure in the line 23 to increase to a pressure which is equivalent to the load pressure and the spring 24.

The system pressure of the fluid from the pump 14 is transmitted in the pressure relief valve 20 via a path 26, to act on the actuating part to oppose the force of the spring 24 and the load pressure. Thus the greater the load pressure which tends to close the path for the system fluid through the valve 20, the greater the system pressure and thus the greater the fluid flow through the control valve 16 to the actuator 12.

It will be appreciated that in use, there will thus be a pressure drop across the control valve 16 i.e. the system pressure will be higher than the load pressure by an amount equivalent to the force provided by the spring 24. When the control valve 16 is fully closed and the actuator 12 is stationary, the flow control apparatus 14 will open to relieve all fluid flow generated by the pump, at a system pressure which is just greater than that needed to overcome the force of the spring 24.

As the control valve 16 is opened, the increase in load pressure will be effective to increase the system pressure and increase fluid flow through the control valve 16, thus reducing the flow of system fluid relieved through the pressure relief valve 20.

Typically a control valve 16 has a characteristic flow, that is the spool or other control valve 16 is configured to permit a particular flow for a given extent of opening, For applications where actuator 12 speed is a priority, the spool would be designed so that a larger fluid flow would be permitted for a given smaller spool movement compared to in an application where finer control is required, when the spool would be designed to permit of smaller fluid flows for greater spool movements.

For an actuator 12 which may be used for either moving a loaded bucket B from a loading to an unloading location when rapid actuator 12 operation is desirable, or for excavating when fine control of the bucket B movement is desired, the control valve 16 design is usually a compromise.

In accordance with the present invention however, the control pressure which is provided to the pressure relief valve 20 although derived from the load pressure and hence dependant upon the load pressure, is selectively variable by virtue of the provision of a pressure control device 30. By varying the control pressure which supports the spring 24 to tend to close the fluid control apparatus 10, the effective characteristic of the control valve 16 can be changed either to provide for greater fluid flows to the actuator 12 when rapid actuator 12 operation is required for smaller control valve 16 movements, or to provide for lesser fluid flows to the actuator 12 for greater control valve 16 movements, where finer control is required.

In the example of FIG. 2, the pressure control device 30 includes a simple electrically or pilot operated changeover valve 32 which may manually be operated by an operator operating a control F within a cab C of the machine M, to change the control pressure which is transmitted to the flow control apparatus 20. As well as being selectively operable by the operator, the changeover valve 32 may be responsive to an input from a controller which depends on any desired operating parameters.

In each case, the state of the changeover valve 32 may be selectively changed to deliver the control pressure fluid at either the load pressure through a first unrestricted control pressure delivery path 33, or a modified pressure less than the load pressure, through a second control pressure delivery path 34 which includes a pressure reducing orifice 35.

Thus for rapid actuator 12 operation, the changeover valve 32 is operated to deliver the control pressure at load pressure along the first pressure delivery path 33 and hence to the flow control device 30, and for slower more controlled actuator 12 operation, the changeover valve 32 is operated to deliver the load pressure to the pressure reducing orifice 35 to reduce the load pressure to the modified control pressure.

The hydraulic system 10 of FIG. 2 may be modified in many ways without departing from the scope of the invention. For example, the pressure control device 30, instead of including a changeover valve 32, could alternatively include a variable orifice which may be manually controlled and/or controlled by a controller depending on operating parameters, to vary the control pressure, or by a pilot pressure generated by a manual control which operates the control valve 16. In this event, rather than having just two alternative states, the operator and/or the controller may be able to operate the pressure control device 30 to vary the control pressure between the load pressure and a larger number or an infinite number of operating states lower than the load pressure.

In the example in FIG. 2, the control valve 16 is within a valve block 18, and the line 23 for the system pressure fluid to the pressure relief valve 20 is shown emanating from within the valve block 18, but in another example, this may be connected to a line 36 from the pump 14, upstream of the valve block 18. Also the load pressure path to the pressure control device 30 is shown emanating from within the valve block 18, but may be connected to a line 38 from the control valve 16 to the actuator 12 downstream of the valve block 18.

In the example, the valve block 18 is shown with only one control valve 16 but in another example there may be a plurality of control valves each to control different actuators/services of the working machine M. The load pressure which is communicated to the pressure control device 30 may, where a plurality of the control valves 16 may be operated simultaneously, be the load pressure attributable to the loads experienced by all the actuators/services thus operated. Thus the pressure relief valve 20 will be responsive to the overall requirement for pressurized fluid by all the actuators/services 12, i.e. a maximum load pressure.

A further feature of the system 10 shown in FIG. 2, is the provision of a drain line 40 connected to the line 28 between the pressure control device 30 and the pressure relief valve 20, the drain line 40 extending via a restrictor 41 to the low pressure region 15. The drain line 40 and restrictor 41 permit pressurized fluid at the control pressure which is trapped between the pressure reducing device 30 and the flow control apparatus 20 when the control valve 16 is closed, to escape to the low pressure region 15 so as to allow the opening of the pressure relief valve 20 at a low pressure.

Figure 3:
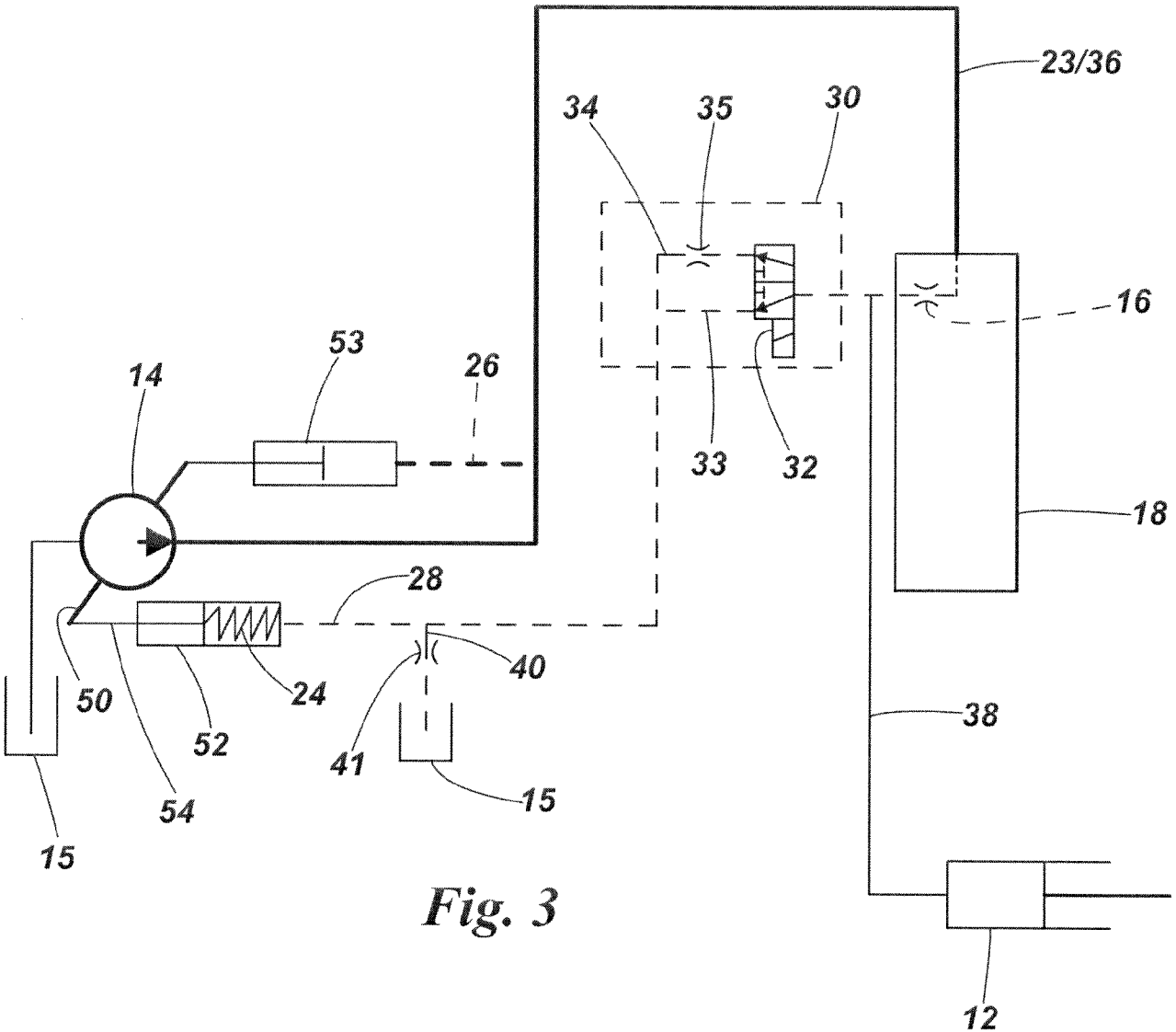
FIG. 3 is an illustrative diagram of a second hydraulic system in accordance with the present invention.

Referring now to FIG. 3, an alternative embodiment is diagrammatically illustrated. In this example, similar parts to those described with reference to FIG. 2 are given the same references.

In this embodiment, instead of a fixed capacity pump which delivers a constant flow of pressurized hydraulic fluid for a given engine E speed, the pump 14 is a variable capacity pump 14. For example, the pump 14 may be a moveable swashplate type of pump, the angle of the swashplate 50 being changeable to change the displacement of piston-cylinder pumping devices which are carried on a rotatable structure and which interface with the swashplate 50. However other variable capacity pumps are known which have actuating parts other than swashplates, the positions of which are variable to change the output capacity of the pump 14. Thus the present invention is not restricted to swashplate type pumps.

In the example, the swashplate 50 is an actuating part of a flow control apparatus as will be described. The angle of the swashplate 50 is changeable to vary the pump 14 output, by a pair of actuating structures 52, 53.

A first actuating structure 52 is a piston and cylinder type device which acts on the swashplate 50 to one side of a fulcrum to urge the swashplate 50 in a first direction, clockwise as drawn such as to maximize the pump 14 output. The structure 52 includes a resilient device, namely a spring 24, which urges the piston of the structure 52 such as to move an actuating rod 54 attached to the piston, to pivot the swashplate 50 in the first direction towards a position in which the pump 14 delivers a maximum flow of pressurized fluid, at a system pressure, to a line 23/36. The system pressure opposes the swashplate 50 movement via the second actuating structure 53 which again is a piston and cylinder type device, a piston of the device 53 being urged by system pressure delivered to the second actuating device via a line 26, to move the swashplate 50 in a second direction, anti-clockwise in the example as drawn, to a position in which the pump 14 delivers a minimum or nil flow of fluid to the line 23/36.

In this example a single control valve 16 is indicated in a valve block 18, and as with the FIG. 2 embodiment, fluid which is delivered by the control valve 16 to the actuator 12, depends upon the operation of the control valve 16 by an operator operating a manual control. Fluid from the line 23/36 passes through the control valve 16 and is delivered to the actuator 12 along load line 38.

As with the FIG. 2 embodiment, there is provided a pressure control device 30 which includes a changeover valve 32 and a restrictor 35. Load pressure fluid from the load line 38 is communicated to the pressure control device 30 which delivers a control pressure, being either the load pressure via first unrestricted load path 33, or a modified pressure lower than the load pressure via second load path 34 and the restrictor 35, to a line 28 which communicates with the first actuating structure 52 of the pump 14, to act on the piston thereof in a direction to support the spring 24.

In this embodiment, when the control valve 16 (or all of the control valves within the valve block 18) are closed so that there is no load pressure, no fluid is delivered to the actuator 12, and no control pressure will be delivered to act on the piston of the first actuating structure 52 and so the system pressure acting on the piston of the second actuating structure 53, will act on the actuating part swashplate 50, to decrease the output of the pump 14 to minimum level i.e. to a position dependent only upon the spring 24 pressure. The load pressure signal (if any) is drained to the low pressure region 15 via line 40. However as the control valve 16 is opened, and the load pressure increases the control pressure will assist the spring 24 to begin moving the piston of the first actuating structure 52 and hence the swashplate 50, so that the output of the pump 14 increases to increase the system pressure and the flow through the control valve 16, as more system fluid becomes available for delivery to the control valve 16 and hence to the actuator 12.

As with the FIG. 2 embodiment, the changeover valve 32 of the pressure control device 30 is selectively moved between its operating states to vary the control pressure between the load pressure and the modified pressure by the operator and as required, automatic control, depending on whether rapid actuator 12 operation, or slower more controlled actuator 12 operation is required.

As with the FIG. 2 embodiment, there is a drain line 40 and restrictor 41 to allow drainage of pressurized fluid from the line 28 between the pressure control apparatus 30 and the first actuating structure 52 of the flow control apparatus, e.g. when the control valve 16 is closed.

It will be appreciated in the FIG. 3 embodiment, that the actuating part (swashplate) 50 of the pump 14, and the first and second piston and cylinder or other actuating structures 52, 53, together provide a flow control apparatus by means of which the flow of fluid to the control valve 16 can be controlled, to an extent depending on the control pressure provided by the pressure control device 30.

In the FIG. 3 embodiment, various modifications may be made without departing from the scope of the invention.

For example, the pressure control device 30 which is shown may be replaced by a variable orifice device which may provide for more than the two alternative operational states described, to provide for greater variation in the control pressure.

In each case though the control pressure is derived from the load pressure, and is either the load pressure, or a modified pressure less than the load pressure.

The first actuating structure 52 need not be configured as shown with the resilient device 24 within the cylinder of the structure 52, but the resilient device 24 may be external to the cylinder provided it is functional to move the actuating part 50 of the flow control apparatus i.e. the swashplate 50 of the pump 14, so that the pump 14 delivers a greater flow of fluid through the control valve 16 as the load pressures increase.

The valve block 18 typically will include a plurality of control valves 16 e.g. provided by spools for controlling the delivery of pressurized fluid to respective actuators/services of the working machine M, in which case the load pressure from which the control pressure is derived in the pressure control device 30, may be the maximum load pressure where a plurality of actuators/services are simultaneously operated.

Figure 4:
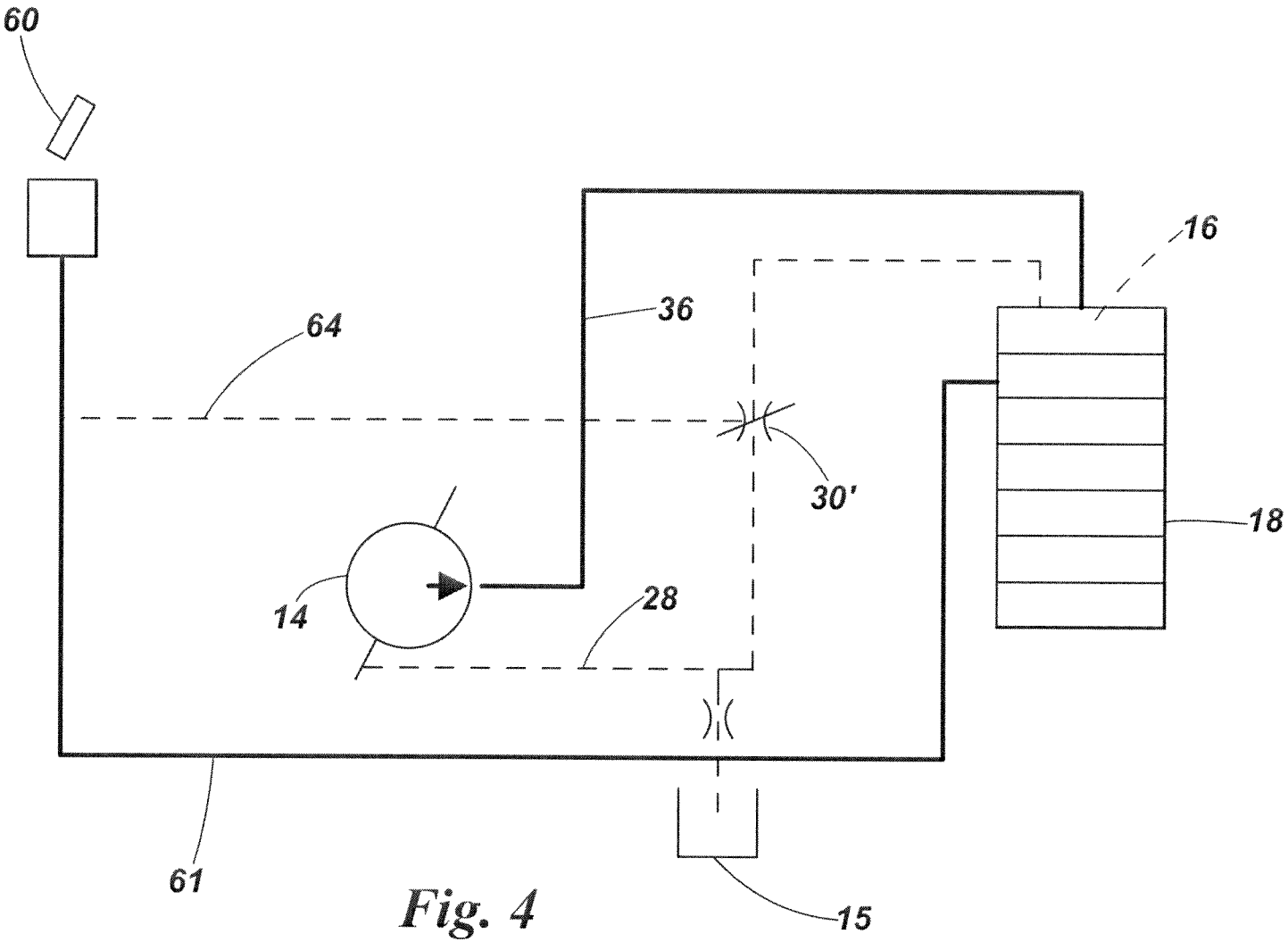
FIG. 4 is a diagram similar to FIG. 3, but showing a modification.

Referring to FIG. 4, a third embodiment of the invention is diagrammatically shown which is similar to the embodiment of FIG. 3, in having a variable capacity swashplate pump 14. In this diagram, the first and second actuating structures 52, 53 are not shown, but are provided as part of a flow control apparatus for varying the output of the pump 14, as is the case in the FIG. 3 described embodiment. The actuator 12 is omitted too in the diagram.

In this embodiment, the pressure control device 30 is a variable orifice 30' which is opened and closed to present a varying restriction to fluid flow, depending upon the operation of a manual control 60, shown in the present example as a joystick 60 control, which generates a pilot pressure on a pilot line 61, to operate the control valve 16 within the valve block 18.

The variable orifice 30' when fully open transmits the load pressure along a line 28 to the flow control apparatus, to support a resilient biasing spring to tend to move the swashplate 50 of the pump 14 to deliver a maximum output. As the variable orifice 30' closes, a reduced, controlled pressure is delivered to the flow control apparatus.

In this example, the pilot signal on the pilot line 61 depends upon the extent of movement of the joystick 60, and thus joystick movement will be indicative of desired actuator 12 speed. Where rapid actuator 12 movement is required, the joystick 60 will be moved further, in which case the pilot signal flow will increase. The pressure of the pilot signal on line 61 is transmitted along a pressure control line 64 to the variable orifice 30' which will be opened to its maximum extent so that the pump 14 is controlled by the actuating structures 52, 53 to deliver the greatest flow of fluid through the control valve 16 for a small joystick 60 movement as a system pressure equivalent to the control pressure plus the force of the spring of the flow control apparatus.

Where finer control of the operation of the actuator 12 is desired, the joystick 60 will be operated with smaller movements, resulting in a lower pressure pilot signal on line 61. This is transmitted to the variable orifice 30' which closes in response to an extent, so that the control pressure transmitted to the flow control apparatus reduces, resulting in a lesser pump 14 output. Thus the pump 14 is controlled to deliver a lesser flow of fluid through the control valve 16 for larger joystick 60 movements.

Figure 5A:
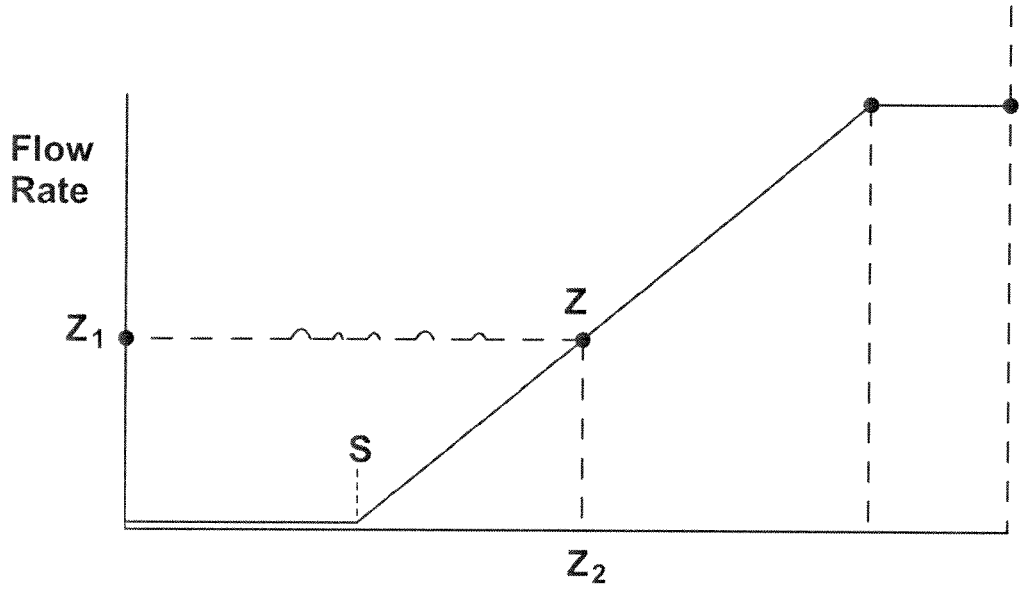
FIGS. 5*a* and 5*b* are graphs which illustrate the use of the invention.

FIG. 5*a* is a graph plotting the position of the spool of a control valve along the x-axis, against the flow through the control valve along the y-axis, in a typical prior art proposal.

It can be seen that for an initial spool movement until the spool has moved a distance S, there is no increase in flow from a zero or minimal flow level, e.g. as a land of the spool moves to open a fluid flow path past the spool. Then from S the flow increases generally linearly as the spool is continued to be moved, over an operating range, until a maximum flow is achieved. For illustration, a point z is shown on the graph, indicative of a maximum desirable fluid flow rate z1 for slow, fine actuator 12 movement, when in this example, the spool will only be moved a small amount z2. For fine actuator 12 control, only a small spool movement can be made between when fluid begins to flow past the hand of the spool at S, and the maximum desirable spool movement z2. Effecting actuator 12 movements over this small spool movement range S-z-2, requires considerable skill on the part of the operator.

Figure 5B:
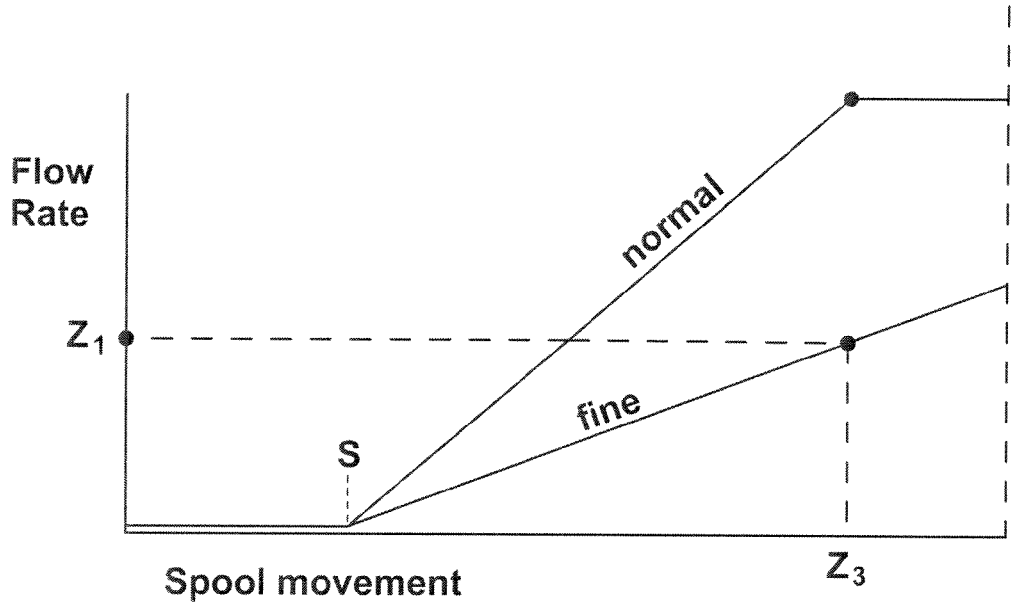

In FIG. 5*b* by contrast, for rapid large actuator 12 movements, the system 10 is operated with the load pressure being delivered to the pressure relief valve 20 (FIG. 1), or to the actuating structure 52 of the swash plate (FIG. 3) as the control pressure.

Where finer actuator 12 control is required, and the control pressure is a reduced load pressure, it can be seen that to achieve the same desired maximum flow z1, as suggested in FIG. 5*a*, a greater spool movement z3 is required, so that an operator has a greater range S to z3 in which to move the spool thus enabling the operator to achieve finer actuator 12 movement control.

The invention claimed is:

1. A hydraulic system for an operator controlled machine, the system including at least one actuator for moving a machine component, a source of pressurized fluid for delivering pressurized fluid at a system pressure to a control valve which is operable under operator control, to control the flow of fluid from the source through the control valve to the actuator along at least a load pressure path defined between the control valve and the actuator, a flow control apparatus for controlling the system pressure and hence flow of fluid from the source through the control valve depending on the load pressure in the load pressure path, the flow control apparatus including an actuating part which is biased by a resilient device to a condition in which the flow control apparatus provides for a maximum flow of fluid to the control valve, actuating part movement by the resilient device being supported by fluid at a control pressure, the control pressure being derived from the load pressure in the load pressure path, and wherein the system includes a pressure control device to which the load pressure in the load pressure path is communicated, the pressure control device being operated under operator control either to deliver the control pressure to the flow control device at the load pressure in the load pressure path or a modified pressure which is less than the load pressure in the load pressure path.

2. A system according to claim 1 wherein the source is a fixed capacity pump, and the flow control apparatus is a pressure relief valve, the actuating part being a valve member in a flow path though a valve body, the valve member being moveable in a passage in the body and being acted upon in one direction by the resilient device and the control pressure fluid, and in the opposite direction by the system pressure fluid.

3. A system according to claim 2 wherein the body includes a system pressure fluid inlet port for system pressure fluid which is connected to the source, and a port for control pressure fluid which is connected to the load pressure path.

4. A system according to claim 3 wherein there is a relief drain to a low pressure region to relieve any trapped control pressure fluid between the pressure control device and the flow control apparatus.

5. A system according to claim 1 wherein the source is a variable capacity pump, the flow control apparatus including an actuating part of the pump which is moveable to increase or decrease the capacity of the pump.

6. A system according to claim 5 wherein the actuating part is a swashplate.

7. A system according to claim 5 wherein the resilient device of the flow control apparatus acts to bias the actuating part in a first direction to move the actuating part so that the pump delivers a maximum output pressure and hence flow of fluid through the control valve.

8. A system according to claim 7 wherein the system pressure fluid is communicated to act on a piston connected to the actuating part, to oppose the biasing of the resilient device to tend to move the actuating part to decrease the output of the pump.

9. A system according to claim 8 wherein the control pressure fluid is communicated to a further piston connected to the actuating part to support the biasing of the resilient device.

10. A system according to claim 9 wherein the resilient device is provided in a cylinder which houses the piston on which the control pressure acts, to act on the piston with the control pressure.

11. system according to claim 1 wherein the pressure control device is a changeover device which is operated to deliver the control pressure fluid at either the load pressure in the load pressure path through a first control pressure delivery path, or the modified pressure through a second control pressure delivery path which includes a pressure reducing orifice.

12. A system according to claim 1 wherein the pressure control device is a variable orifice which is operated to vary the control pressure from the load pressure in the load pressure path to a modified load pressure depending on the extent of opening of the variable orifice.

13. A hydraulic system as defined in claim 1 further including a drain line connected between the pressure control device and the flow control apparatus, the drain line extending via a restrictor to a low pressure region.

14. A working machine which includes a hydraulic system, the hydraulic system including at least one actuator for moving a machine component, a source of pressurized fluid for delivering pressurized fluid at a system pressure to a control valve which is operable under operator control, to control the flow of fluid from the source through the control valve to the actuator along at least a load pressure path defined between the control valve and the actuator, a flow control apparatus for controlling the system pressure and hence flow of fluid from the source through the control valve, depending on the load pressure in the load pressure path, the flow control apparatus including an actuating part which is biased by a resilient device to a condition in which the flow control apparatus provides for a maximum flow of fluid to the control valve, actuating part movement by the resilient device being supported by fluid at a control pressure, the control pressure being derived from the load pressure in the load pressure path, and wherein the system includes a pressure control device to which the load pressure in the load pressure path is communicated, the pressure control device being operated under operator control either to deliver the control pressure to the flow control device at the load pressure in the load pressure path or a modified pressure which is less than the load pressure in the load pressure path.

15. A working machine as defined in claim 14 further including a drain line connected between the pressure control device and the flow control apparatus, the drain line extending via a restrictor to a low pressure region.

16. A method of operating a hydraulic system of an operator controlled machine, the hydraulic system including at least one actuator for moving a machine component, a source of pressurized fluid for delivering pressurized fluid at a system pressure to a control valve which is operable under operator control, to control the flow of fluid from the source through the control valve to the actuator, along at least a load pressure path defined between the control valve and the actuator, a flow control apparatus for controlling system pressure and hence the flow of fluid from the source through the control valve depending upon the load pressure in the load pressure path, the flow control apparatus including an actuating part which is biased by a resilient device towards a condition in which the flow control apparatus provides for a maximum flow of fluid to the control valve, actuating part movement by the resilient device being supported by fluid at a control pressure, the control pressure being derived from the load pressure in the load pressure path, and wherein the system includes a pressure control device to which the load pressure in the load pressure path is communicated, the method including operating the pressure control device to deliver the control pressure to the flow control device at the load pressure in the load pressure path, the method further including operating the pressure control device to deliver the control pressure to the flow control device at a modified pressure which is less than the load pressure in the load pressure path.

17. A method as defined in claim 16 wherein the step of operating the pressure control device to deliver the control pressure to the flow control device at the load pressure in the load pressure path enables normal control of the actuator by the control valve; and the step of operating the pressure control device to deliver the control pressure to the flow control device at the modified pressure which is less than the load pressure in the load pressure path enables fine control of the actuator by the control valve.

18. A method of operating a hydraulic system as defined in claim 16 further including a drain line connected between the pressure control device and the flow control apparatus, the drain line extending via a restrictor to a low pressure region.

* * * * *